United States Patent [19]

Thiene

[11] 4,274,070

[45] Jun. 16, 1981

[54] PROXIMITY INSTANT-ON SWITCH FOR MEDICAL AND DENTAL INSTRUMENTS

[75] Inventor: Paul G. Thiene, Laguna, Calif.

[73] Assignee: Surgical Mechanical Research Corp., St. Louis, Mo.

[21] Appl. No.: 66,507

[22] Filed: Aug. 14, 1979

[51] Int. Cl.[3] ..... H01H 9/00

[52] U.S. Cl. ..... 335/205; 128/303.13; 128/800

[58] Field of Search ..... 335/153, 205, 207; 128/303.1, 800; 340/568; 200/85 R

[56] References Cited

U.S. PATENT DOCUMENTS

| | | | |
|---|---|---|---|
| 3,161,742 | 12/1964 | Bagno | 335/207 X |
| 3,426,166 | 2/1969 | Canceill | 335/205 X |
| 3,461,874 | 8/1969 | Martinez | 335/205 X |

FOREIGN PATENT DOCUMENTS

| | | | |
|---|---|---|---|
| 1269438 | 4/1972 | United Kingdom | 335/205 |

*Primary Examiner*—George Harris

*Attorney, Agent, or Firm*—Harness, Dickey & Pierce

[57] ABSTRACT

A proximity instant-on switch for medical and dental instruments that includes a magnetically-responsive switch incorporated into the handle of the instrument and a permanent magnet embedded into the instrument cradle at a position adjacent the location of the switch when the instrument is placed in the cradle. The presence of the magnetic field created by the magnet maintains the switch in its open state while the instrument is in place in the cradle. However, upon removal of the instrument from the cradle, the loss of the magnetic field closes the switch thereby automatically energizing the instrument.

2 Claims, 2 Drawing Figures

PROXIMITY INSTANT-ON SWITCH FOR MEDICAL AND DENTAL INSTRUMENTS

BACKGROUND AND SUMMARY OF THE INVENTION

The present invention relates to instant on/off switches for controlling medical and dental instruments and in particular to a switch that is adapted to automatically energize an instrument when the instrument is removed from its holder.

Medical and dental opertory units typically have numerous electrically operated instruments that rest in holders located on the unit. The holders or "cradles" act as instant-on switches and are generally spring-biased against the weight of the instruments so that when an instrument is removed from its holder, the cradle pivots upward actuating a switch which energizes the instrument. This arrangement is similar to that utilized for the receivers on most wall-mounted telephones. The disadvantage with this arrangement, however, is that a relatively expensive spring-activated microswitch is required which must be hand-wired and mounted inside a plastic box situated within the unit. In addition, the need for a separate microswitch in the unit constrains the position of the instrument holder to a location on the unit that is accessible for wiring purposes. Moreover, the existence of numerous spring-actuated microswitches in a unit increases the complexity of the wiring harness for the unit.

The present invention seeks to overcome these disadvantages by providing an instant-on switching arrangement that eliminates the need for a spring-actuated microswitch. In addition, in the preferred embodiment of the present invention, the need for an internal switch which must be separately wired is eliminated completely. Thus, the complexity of the wiring harness required for the unit is significantly reduced.

The present invention accomplishes these results by providing a magnetically-actuated switch that is incorporated into the handle of the instrument and is electrically connected in series with the instrument load. A permanent magnet is embedded in the instrument holder. When the instrument is in the holder, the proximity of the permanent magnet to the magnetically-actuated switch in the handle of the instrument maintains the switch in its open condition, thereby cutting off electrical power to the instrument. When the instrument is removed from the holder, however, the absence of the magnetic field closes the switch in the handle of the instrument, thus energizing the instrument. Moreover, when the instrument is returned to its holder, the instrument is again automatically de-energized.

Additional objects and advantages of the present invention will become apparent from a reading of the detailed description of the preferred embodiment which makes reference to the following set of drawings in which:

DETAILED DESCRIPTION OF THE PREFERRED EMBODIMENT

Figure 1:
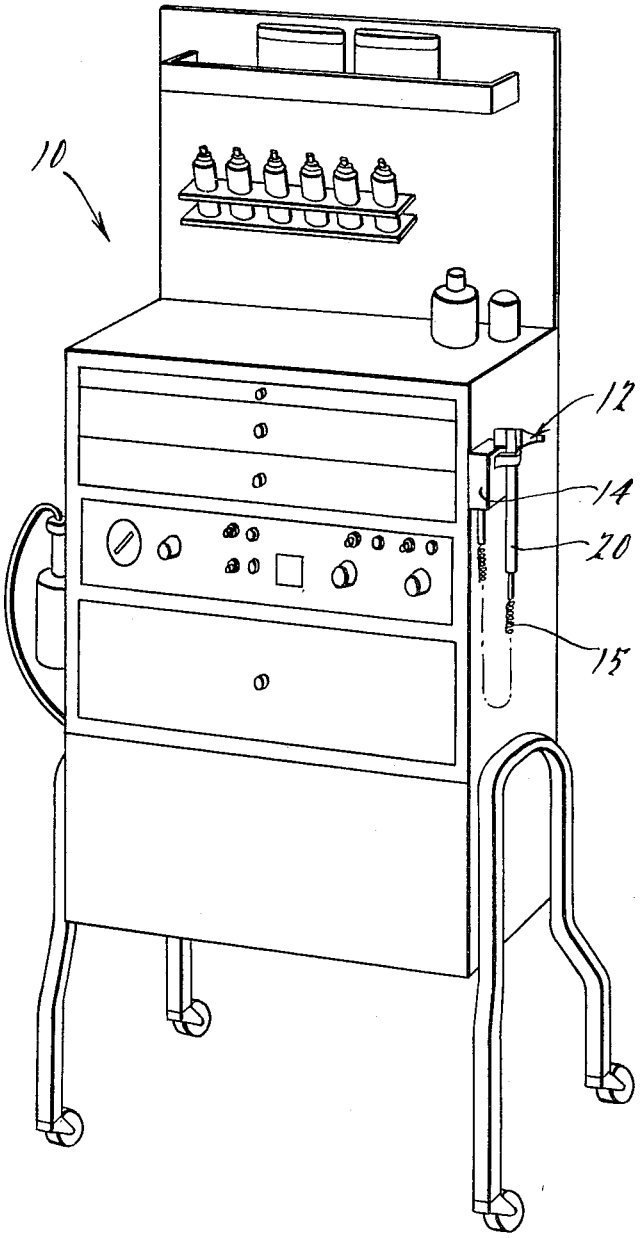
FIG. 1 is a pictorial representation of a medical opertory unit to which the present invention pertains.

Referring to FIG. 1, a pictorial representation of a medical opertory unit 10 is shown. Units of the general type to which the present invention pertains are typically utilized in medical and dental offices and generally include a plurality of electrically operated instruments 12. These instruments may for example comprise diagnostic devices such as an otoscope, or a motorized instrument such as a dental drill. The instrument 12 typically mounts to a holder or "cradle" 14 that is fastened to the opertory unit 10. Electrical power is provided from the unit 10 to the instrument 12 via a cord 15 that extends from the handle 20 of the instrument 12. The instrument 12 could alternatively be battery operated, however, in which case the cord would not be required.

Figure 2:
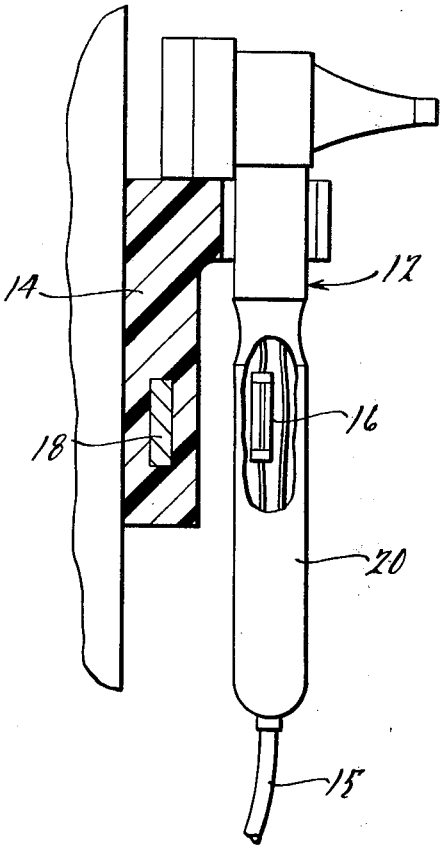
FIG. 2 is an enlarged partial cutaway and sectional view taken along line 2—2 in FIG. 1 illustrating the magnetically-actuated switch in the handle of the instrument and the location of the permanent magnet in the instrument holder.

With particular reference to FIG. 2, an enlarged detailed view of an instrument 12, herein an otoscope, is shown resting in its holder 14 fastened to the side of the unit 10. Incorporated in the handle 20 of the instrument 12 is a magnetically responsive switch 16 that is connected in series with the instrument load, herein an incandescent lamp (not shown). The magnetically responsive switch 16 utilized in the preferred embodiment is an axial-travel switch, however, it will be appreciated that other magnetically responsive switches, such as magnetic reed switches or Hall-effect switches could be substituted. The axial-travel type switch is preferred in this embodiment because it is better suited to carry the current drawn by the instrument load.

Embedded in the instrument holder 14 is a permanent magnet 18. The magnet 18 is disposed in the holder 14 directly adjacent the location of the axial-travel switch 16 in the handle 20 of the instrument 12 when the instrument is properly placed in the holder 14. In this manner, the axial-travel switch 16 will be affected by the presence of the magnetic field created by the permanent magnet 18 when the instrument 12 is placed in the holder 14. In particular, when the instrument 12 is positioned in the holder 14 as shown, the magnetic field created by the permanent magnet 18 causes the switch 16 to remain in its open state, thereby cutting off power to the instrument 12. However, when the instrument 12 is removed from the holder 14, the switch 16 is removed from the influence of the magnetic field of the magnet 18, thus causing the switch 16 to close and automatically energize the instrument 12. Similarly, when the instrument 12 is returned to its position in the holder 14, the switch 16 is again opened by the presence of the magnetic field created by the magnet 18, and the instrument 12 is de-energized.

Thus, it will be appreciated that the present invention discloses an improved instant-on switching arrangement for medical and dental instruments which not only eliminates the relatively expensive spring-actuated microswitch assemblies presently in wide use, but also eliminates entirely the need for a separate switch located internally of the unit. Consequently, the complexity of the wiring harness for the unit is reduced and a substantial savings in manufacturing expense is realized.

While the above description constitutes the preferred embodiment of the present invention, it will be appreciated that the invention is susceptible to modification, variation and change without departing from the proper scope or fair meaning of the accompanying claims.

What is claimed is:

1. A proximity instant-on switch for an electrical medical or dental instrument that is adapted to seat in a holder disposed on a medical or dental unit, comprising magnetic switching means including a permanent magnet embedded in said holder and a magnetically-responsive switch member electrically connected to the instrument load and disposed in the handle of the instrument such that when the instrument is placed in said holder the instrument is de-energized by said magnetic switching means and when the instrument is removed from said holder the instrument is automatically energized by said magnetic switching means.

2. The proximity instant-on switch of claim 1 wherein said magnetically-responsive switch comprises an axial-travel type switch that is connected in series with the instrument load.

* * * * *